United States Patent [19]

Martin

[11] Patent Number: 4,660,728

[45] Date of Patent: Apr. 28, 1987

[54] FLYING SOUND SYSTEMS

[75] Inventor: David N. H. Martin, London, England

[73] Assignee: Martin Audio Ltd., Buckinghamshire, England

[21] Appl. No.: 657,779

[22] Filed: Oct. 4, 1984

[30] Foreign Application Priority Data

Oct. 4, 1983 [GB] United Kingdom ..... 8326524

[51] Int. Cl.[4] ..... A47F 5/08

[52] U.S. Cl. ..... 211/118; 248/323

[58] Field of Search ..... 211/113, 116, 117, 118, 211/4, 183; 403/325, 327; 248/323

[56] References Cited

U.S. PATENT DOCUMENTS

| | | | |
|---|---|---|---|
| 2,706,632 | 4/1955 | Chandler | 211/113 X |
| 2,905,806 | 9/1959 | Tunney | 248/323 |
| 2,952,351 | 9/1960 | Stone | 211/113 X |
| 4,377,114 | 3/1983 | Fuller | 211/113 X |
| 4,417,714 | 11/1983 | Charm | 248/323 |
| 4,520,979 | 6/1985 | McInni | 248/323 |

*Primary Examiner*—Ramon S. Britts
*Assistant Examiner*—Sarah A. Lechok Eley
*Attorney, Agent, or Firm*—Leydig, Voit & Mayer

[57] ABSTRACT

Apparatus for flying a sound system is described in which a suspension frame can be winched to a desired height from a roof beam or gantry at a concert venue. The suspension frame has a pair of hanging chains, which are each attached to opposed sides of a loudspeaker cabinet by means of coupling devices. A first webbing loop passes through retaining loops on the rear surfaces of the cabinets and through a tensioning device to ensure that the rear edges are kept in tight contact. A second webbing loop extends from a roof beam or gantry to a lowermost cabinet and includes a second tensioning device. Adjustment of the spacing of the coupling devices on the chain, the tension applied by the second tensioning device and the position of the connection point on the gantry relative to the chains together contribute to enable various required configurations of the speakers in a flown sound system to be achieved, and reproduced after dis-assembly and re-assembly.

A coupling device is also described in which a fastening peg is received in an opening in a housing and is locked therein by a sliding member which engages an annular recess in the fastening peg. Means for locking the sliding member in its locking position and enabling release of the fastening peg by manual forces in orthogonal directions are also provided.

9 Claims, 13 Drawing Figures

FIG. I.

FLYING SOUND SYSTEMS

The present invention relates to flying sound systems and in particular to coupling devices by means of which loudspeakers may be coupled to a chain or cable to enable them to be flown.

The technique of suspending components of a sound system normally loudspeakers, from roof beams or specially erected gantries is known as "flying". It is normally necessary to elevate loudspeakers in this way in order to provide the required sound coverage for large audiences at pop festivals and concerts both indoors and outdoors. The equipment to be flown may include both loudspeakers and other sound processing and amplifying equipment. In the following discussion the term "loudspeaker" will be used to generally indicate any component of a sound system or other item which may be flown with the sound system. It will be appreciated that any group of loudspeakers that are flown together may include various types and sizes of loudspeakers to provide the required sound output.

Typically when pop groups or artists are on tour there is a requirement to erect a sound system at each venue before the concert takes place and dismantle the sound system afterwards, preferably in time for it to be re-erected at the next venue which may be some distance away. It will be appreciated therefore that any flying system should be capable of rapid erection and dismantling.

Depending on the type of music being reproduced at the concert, the size of the venue and possibly structural limitations, the actual components of the sound system to be flown may vary. Loudspeakers themselves are mounted in individual cabinets each containing one or more related speakers. Therefore any system for flying loudspeakers should be capable of connecting the speaker cabinets to the flying chain or cable in any desired order. It is also frequently necessary to bow the stack of loud speakers in order to provide the required sound coverage in the auditorium. Bowing may be necessary when part of the audience are seated in close proximity to the speakers. The bowing of the stack provides downward as well as forward sound coverage. The extent of bowing required may also vary in dependence on the particular application of the sound system and should be capable of easy adjustment.

Another important consideration in the flying of all sound systems is safety. There should be no risk of the loudspeakers falling from their elevated positions since in many cases the loudspeakers will be mounted directly above a portion of the audience. Further, of course, the loudspeaker equipment will be damaged in any fall.

Previously, various techniques have been employed for the flying of sound systems. In most instances individual loudspeaker cabinets are separately mounted to one or more cables, chains or straps which are then raised by appropriate lifting gear.

With such arrangements it is difficult to control the angles at which the various loudspeaker cabinets hang relative to the chain or to achieve any controlled degree of bowing in the stack.

In order to connect the loudspeaker cabinets to the cable or chain various coupling devices have been used, such as belt and buckle type fittings and claw devices which can be coupled to a fixed stud, ring or bar mounted on the speaker case. In other constructions hooks and D rings have been employed. None of these coupling devices has proved entirely satisfactory in providing the required features discussed above for such a system. In particular two hands are frequently required to connect or disconnect such coupling devices particularly if the speaker has to be positioned at the same time and their operation may be awkward. It is also important that the fittings should not become disconnected in use.

According to the invention, there is provided apparatus for flying a sound system including a plurality of loudspeaker cabinets, said apparatus comprising a suspension frame or other support structure beneath which the loudspeaker cabinets are suspended, means for adjusting the orientation of the cabinets relative to one another, and means for securing the suspended cabinets in the adjusted positions, said adjustment securing means also depending from the suspension frame or other support structure.

The loudspeakers are preferably suspended on a pair of chains depending from the suspension frame or other support structure, each of the two sides of each loudspeaker cabinet being pivotally connected to a respective one of the chains, preferably the pivot axis passing through the centre of gravity of the cabinet.

The positioning device may comprise a webbing strap depending in a loop from the suspension frame or other support structure, each loudspeaker cabinet being releasably connected to the webbing strap. The relative orientations of the loudspeaker cabinet may be adjusted by varying the length of the loop.

The invention also provides a coupling device for a loudspeaker or other cabinet comprising a housing and a fastening peg receivable in an opening of the housing, the housing including means operable upon insertion of the peg in the opening which may be adapted to lock automatically the peg therein.

More specifically the invention provides a device for coupling a member to a chain or cable, comprising a housing mounted to said member, said housing defining a channel in which a slide member is longitudinally movable between a first, locked, position and a second, open, position, said slide member being held by holding means in said second open position against biasing means biasing it towards said first position, said housing and slide member each having defined therein openings for receiving a fastening peg, which openings overlie, in the second position of the slide member, one end portion of said fastening peg having an annular recess in which the edge of said opening in the sliding member engages when the slide member is in the first position, the other end portion of said peg having an axially extending slot formed therein adapted to receive the cable or chain, means for retaining said cable or chain within said slot, and actuating means operable when said one end portion of said fastening peg is fully received in the openings in order to release said holding means and allow the slide member to slide into the first position thereby retaining the fastening peg in said housing.

It will be appreciated that since the actuating means is operated by the insertion of the fastening peg into the opening, the above defined coupling device can be readily operated using only one hand. Even if the actuating means are omitted, the coupling device can still be operated to lock or unlock the peg with one hand.

Preferably locking means are provided for the positive retention of the slide member in its first position together with release means for disengaging said locking means, which release means require to be moved in two directions in order to disengage said locking means and return the slide member to the second position to permit removal of the peg. The two directional movement provides an additional safety factor in avoiding inadvertent release of the peg. Nonetheless, the release means can still be readily operated to release the peg with one hand. The slide member may have an extension which acts as an indicator as to whether or not the member is fully engaged.

The above defined coupling device is particularly useful for connecting loudspeaker cabinets to a suspension cable or chain in apparatus for flying a sound system.

An embodiment of the invention will now be described, by way of example only, with reference to the accompanying diagrammatic drawings, in which.

Figure 1:
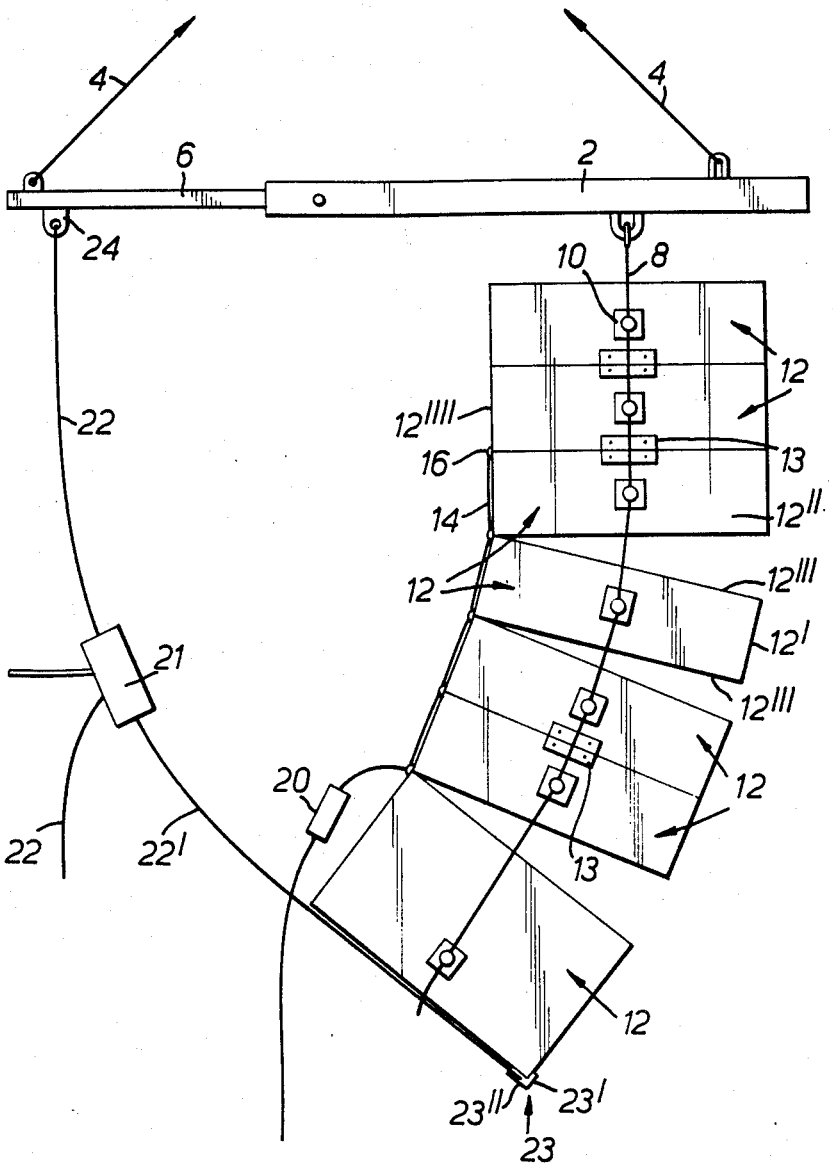
FIG. 1 is a side view of apparatus for flying a sound system in accordance with the present invention.

FIG. 1 diagrammatically illustrates apparatus for flying a sound system. The apparatus consists of a suspension frame 2 which is connected by means of cables 4 to a winch motor (not shown). The suspension frame is substantially rectangular in cross-section and has a rear extension arm 6 which can be moved telescopically relative to the main frame 2 to adjust its length.

Alternatively, the frame may include a base member, two second members extending at right angles from the base member, two third members extending at approximately 45° to respective ends of the second members remote from the base member and meeting at an apex. An elongate fourth member extends from the centre of the base member through the apex and beyond the basic members of the frame to form an extension. The fourth member extends parallel to the second members and has locations by which a device can be connected for adjusting the relative positions of speaker cabinets.

From the main part of the suspension frame 2 (as illustrated or the alternative) two main suspension chains 8, of which only one is visible, are hung. It is preferred to use chains as these allow for more convenient positioning of the loudspeaker cabinets with less risk of slippage, but cables, strips of metal with pivoting links, or webbing could also be employed. The suspension chains 8 are connected by means of coupling devices 10 to opposed sides of loudspeaker cabinets 12. It should be mentioned that each cabinet has a sound-radiating face 12', two sides 12'', two end faces 12''' and a base 12''''. The latter will normally have castors to facilitate movement over a floor. Each loudspeaker cabinet 12 has two coupling devices 10 one mounted on each opposite side 12''. The coupling devices 10 are described in more detail hereinafter with reference to FIGS. 2 to 6. The coupling devices allow the chain to move substantially in a hemisphere based on the side surface of the cabinet. In a modification, the range of movement is less than a complete hemisphere, as will be described hereinafter with reference to FIGS. 8 and 8A. However, the apparatus is not specifically restricted to the use of such coupling devices and other known devices may be employed if desired.

The cabinets 12 are mounted at the desired relative spacing in order to produce the required sound coverage. As illustrated the first, uppermost, three cabinets are secured together to form a single block. The adjacent cabinets are bolted by means of a plate 13 at either side which is fixed to the two cabinets by bolts at the corners of the plate 13. Two further cabinets lower down the stack are also bolted together. It will be noted that cabinets which are bolted together in this way always remain parallel. The relative spacing of the other cabinets is determined by the required configuration of the completed sound system. In the illustrated system the lower cabinets are desired to fall in a bow, which is exaggerated in the interest of clarity.

The two side mounted coupling devices 10 on each cabinet are arranged so that a line joining the two passes through the centre of the gravity of the loudspeaker cabinet. However, because of the actual configuration of the cabinets this may not always be possible. Moreover, because of the different sizes of cabinet, if it is desired for the front faces of each cabinet to be aligned, then this condition cannot be satisfied in the case of all cabinets. Thus some of the cabinets will show a tendency to hang from the suspension chains out of horizontal. Of course, if it is desired that the entire stack of cabinets should exhibit bow, it is necessary, in any event, for some of the cabinets to be out of horizontal.

In order to control the orientations of the cabinets of the stack, a positioning device is provided which consists of a first length of webbing 14 connected at the upper end to any convenient cabinet of the stack of cabinets at an upper edge by means of a loop-like member which engages a loop-retaining means 16 referred to in detail hereinafter. The cabinet selected for attachment can be any one of a close-coupled group, but must be secured to the lowermost one. The webbing 14 also passes down through further loop-retaining means 16 mounted to the top and bottom of the rear face of each cabinet. The lower end of this length is engaged by means of a loop-like member to the retaining means 16 of the lower edge of the lowermost cabinet of the stack or if the lowermost cabinet forms one of a close-coupled group, then any of the group will be satisfactory. A second length of webbing also forms a part of the device. Any suitable means may be provided for attaching these retaining webbing loops 16. The loop-retaining means may consist of pieces of angle iron each with a slot of suitable size milled through one arm to act on the retaining loop and with the other arm bolted to the cabinet. The webbing 14 is shown, for convenience, spaced from each cabinet except at the edges where it passes through the slots in the angle iron brackets. In practice, the webbing will be in close contact with the base surfaces.

Figure 7:
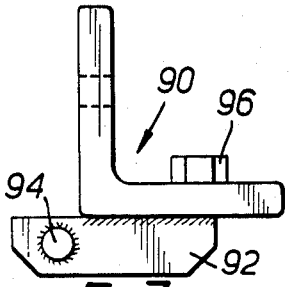
FIG. 7 is an end elevation of a bracket forming a part of the apparatus.

FIG. 7 illustrates a preferred bracket 90 (loop-retaining means) by which the webbing 14 can be attached to opposed rear edges of the cabinets. The bracket comprises a length of equal angle section of metal, having, centrally of its length two webs 92 (only one shown) which are spanned by a circular section rod or tube 94, the centre line of which substantially coincides with the corresponding edge of the cabinet. The angle bracket is secured to the inside of the cabinet by means of bolts and/or studs. If studs are used, captive nuts 96 will be provided.

The lower end of the webbing 14 is looped through one of the angle bracket rods 94 or other loop-retaining means and then passes into a tensioning device 20 which serves to hold the adjacent edges of the cabinets tightly together when an appropriate degree of tension is applied. A conventional, readily available, tensioning device for webbing can be used.

Figure 9:
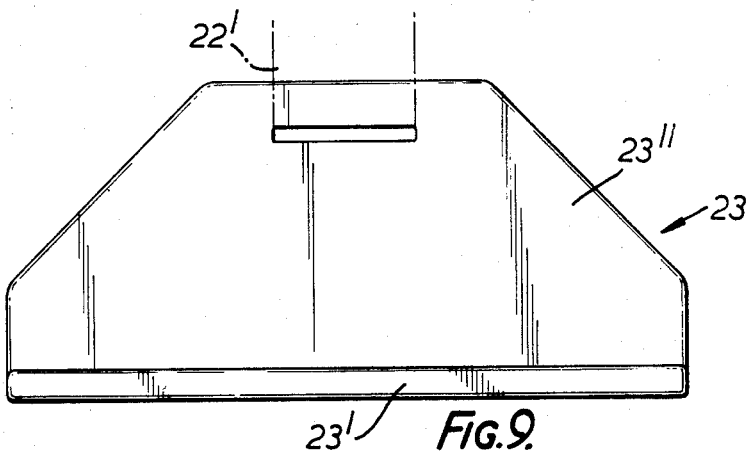
FIG. 9 is a side elevation of a bracket which cooperates with a lowermost one of a series of cabinets.

The second length of webbing 22 is attached to the frame 2 at a connection point 24 on the extension 6. This second length is looped through a second web tensioning device 21 (again conventional) and this serves to vary the effective length thereby serving to adjust the degree of bowing of the stack of cabinets. A further length of webbing 22' is of fixed length and is firmly secured both to the tensioning device 21 and is held to the lowermost cabinet of the stack by a channel section member 23 with unequal limbs 23', 23'' (also shown in FIG. 9). Under the self-weight of the cabinets and the tension in the webbing 22 and 22' the shorter limb 23' is forced firmly into the material adjacent the lowermost edge of the lowermost cabinet.

By adjusting the effective length of the extension arm 6, using a different attachment point 24, the spacing of the cabinets on the chain and the tension in the webbing loop 22, 22', any required bow can be imposed on the stack of speaker cabinets 12. It will be noted that in the stable final position of the cabinets they all touch, as illustrated, and the spacing of the blocks of cabinets and individual cabinets is selected so that this will occur when the desired degree of bow has been achieved. The spacing of the cabinets on the suspension chains 8, the adjustment of the extension 6 and the tension applied to the loop may each be suitably selected by experiment to establish a reproducible arrangement of the stack of loudspeaker cabinets for any required purpose. Thus, once the tensioner 21 has been adjusted and the securing point of the connection eye 24 selected, reassembly of the stack with the same cabinets will give rise to the same degree of bow without further adjustment.

It will be appreciated that whilst the above apparatus has been described in connection with a stack of loudspeaker cabinets 12, any cabinet or other article provided with the necessary coupling devices can be mounted in such a system.

In order to raise the suspension frame 2 together with the assembled stack of cabinets 12 to its required position at the concert venue, the lifting chains 4 are raised by means of an electrically-powered motor which may be supported on a roof girder or a gantry from which the suspension frame is to be suspended. The main weight of the cabinets is carried by the suspension chains 8 which are typically 1.5 tonne chains. The webbing 22, 22' may bear up to a third of the weight of the cabinets but is generally required to bear a lighter load. This load depends on the imposed bow and the initial imbalance of the cabinets. It will be appreciated that in the case of cabinets which are bolted together as groups there may be slack in the chains 8 between the adjacent coupling devices therefore each coupling device 12 must be capable of carrying the full weight of the cabinets below. Some degree of slack is necessary to allow the adjacent coupling devices to be connected. Slackness between cabinets of a group could be avoided by providing only one pair of couplings on each block but this would require special adaptation of some cabinets and also could cause balance problems with larger stacks.

A coupling device 10 which is suitable for use in the hereinbefore described flying apparatus will now be described with reference to FIGS. 2 to 6 and 8 of the accompanying drawings. It will be appreciated that such a coupling device has a wider application than merely in the hereinbefore described apparatus.

The coupling device 10 consists of a housing 30, initially made in two parts with one part formed, in one face, with a deep rectangular section groove or channel. The second part fits into the groove but leaves a space for an elongate slide member 42 of complementary cross-section. The second part does not fully cover the slide member and leaves an end portion of the latter exposed. To ensure full integrity of the housing the first and second parts are provided with chamfers at adjacent edges extending parallel to the slide member so that when assembled, V grooves are formed. These grooves are filled with weld material and the surface ground to a smooth finish. Four bores 34 are provided at the corners of the housing by which the coupling member is secured to the cabinet to be supported. The bores 34 may be countersunk to enable the heads of the bolts or studs to be fully recessed. Central openings 36 which overlie one another in the housing are adapted to receive one end portion of a fastening peg 38.

Figure 5:
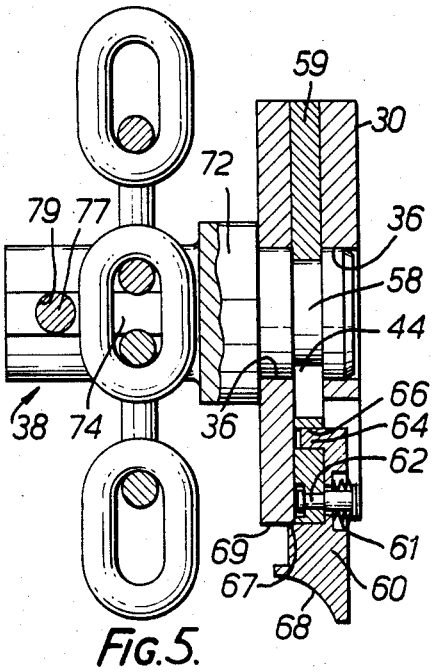
FIG. 5 is a section on the line V—V in FIG. 2.

The slide member 42 can move between a first, locked, and a second, open, position; in FIG. 5 it is shown in the first position in which the fastening peg 38 is locked into the housing. The slide member 42 has an opening 44 defined therein which is shaped so as to coincide with the openings 36 in the housing 30 when the slide member is in its second position and therefore allow the fastening peg 38 to be fully inserted into the housing so that its free end buts on to or at least lies closely adjacent the cabinet to which the device is mounted. The opening 44 in the slide member is defined by an arc 44 of a circle which has the same curvature as the openings 36 and by a larger arc 44'' which has a larger curvature.

Figure 3:
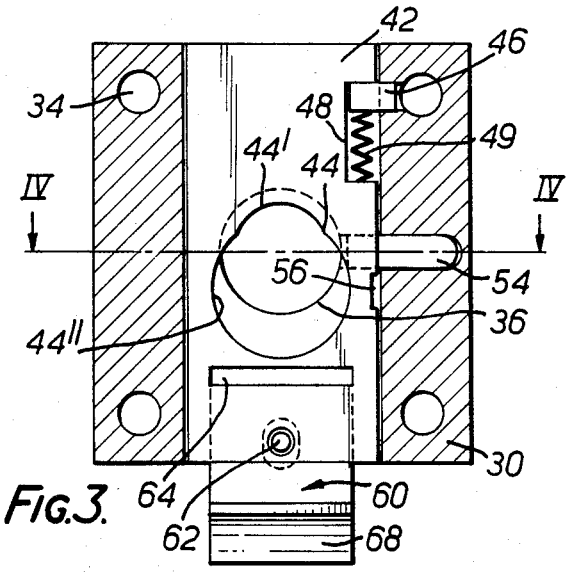
FIG. 3 is a sectional side view of the device of FIG. 2 with the fastening peg removed.
Figure 4:
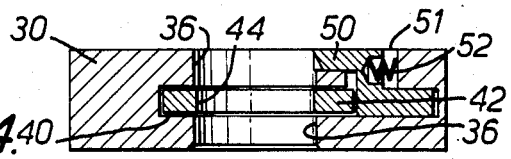
FIG. 4 is a section on the line IV—IV in FIG. 3.

The slide member 42 is constrained only to move between said first and second positions with the aid of a lug 46 which projects from the wall of the channel defined by the housing into the channel 40 and co-operates with a cut-away groove 48 formed in the slide member 42. A helical compression spring 49 is housed in the groove 48 and acts between a surface of the lug 46 and an end wall of the groove 48 to bias the slide member into its first position, as shown in FIG. 3.

Adjacent the edge of the opening 36 in the face of the housing 30 which will be directed towards the cabinet when assembled there is optionally disposed an actuating member 50 the tip of which projects slightly inwardly beyond the periphery of the opening 36 so that when the fastening peg 38 is inserted through the openings 36 in the housing and the slide member 42, the projecting tip of the actuating member 50 is pushed by the chamfered free end of the peg to one side against the force of a biasing spring 52 which acts between an edge of a recess 51 in the housing 30 accommodating the actuating member and a wall of the actuating member 50. The actuating member 50 is formed in one piece with a holding member 54 which, when the tip of the actuating member 50 projects into the opening in the inner plate 30, extends into a recess 56 in the slide member 42 thus holding the latter in its second position. Movement of the actuating member against the force of the spring 52 causes the holding member 54 to be moved away from its recess 56 in the slide member 42 thus allowing the slide member to move under the action of the biasing spring 47 into its first position as shown in FIG. 3. This causes the edge of the opening 44 in the slide member 42 to engage in an annular recess 58 in the fastening peg 38, as best seen in FIG. 5, thereby locking the fastening peg 38 in the housing.

When the slide member 42 moves into its second position to lock the fastening peg 38 in the housing, the upper end surface 59 becomes flush with the surfaces (uppermost when mounted on a cabinet) of the housing 30 as best seen in FIG. 5. This provides a visual indication that the slide member has properly engaged the recess 58 in the fastening peg 38.

At the same time as the slide member 42 moves into its second position a locking member 60 which is mounted at the lower edge of the slide member 42 by means of a pin 62 surrounded by a helical spring 61 moves so that a projecting ridge 64 engages in a transverse slot 66 in the slide member 42 as best seen in FIG. 5. Locking in the illustrated position in also ensured by an edge portion 67 which engages an end edge surface 69 of the housing 30.

This positively locks the slide member and thus the fastening peg. In order to release the fastening peg 38, a conveniently shaped release portion 68 formed integrally with the locking member 60 is pressed towards the associated cabinet and upwardly so as firstly to disengage the projecting edge portion 67 from the end face 69 against the force of the spring 61, and secondly to push the slide member 42 up towards its second open position, against the force of the spring 49 with the ridge 64 continuing in engagement in the slide member. As soon as the slide member 42 reaches it second position, the holding member 54 (if fitted) moves back into engagement with the recess 56 in the slide member 42 under the action of spring 52 thus again holding the slide member 42 in its second or open position allowing the fastening peg 38 to be removed from the housing.

The fastening peg 38 has one end portion which is adapted to be inserted into and locked into the housing as hereinbefore described. This end is formed with the described annular recess 58 with which the edge of the opening 44 in the slide member engages to hold the fastening peg locked into the housing. The fastening peg also has a collar 72 which seats against the outer face of the housing 32 when the fastening peg 38 is correctly positioned within the housing. This provides a further visual indication of the correct alignment of the recess 58 with the channel 40 in which the slide member 42 is housed.

The other end portion of the fastening peg 38 has an axially extending slot 74 defined therein in which a chain link can be received. Surfaces 76 of the slot 74 are shaped so that the juxtaposed chain links are seated against these surfaces, positively holding the chain so that it cannot slip relative to the peg 38. One link 71 spans the slot. This is shown in FIG. 2.

Figure 8:
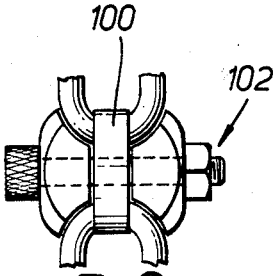
FIG. 8 is an end view showing the peg and part of the chain.
Figure 6:
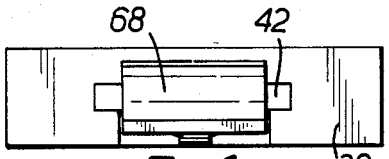
FIG. 6 is a view of the coupling device from below with the fastening chain removed.
Figure 8A:
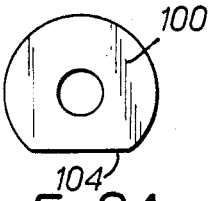
FIG. 8A is a side elevation of a washer which cooperates with the peg.

In order to limit increase the safe load on the chain in a modification shown in FIG. 8 a washer 100 surrounds the bolt of a nut and bolt assembly 102, the washer having a flat 104 which contacts one straight side of the link 71 trapped by the peg thus providing large load transfer surfaces. In this way the possible orientations of the chain relative to the peg are limited to some extent in comparison with those possible with the FIG. 2 construction, but the load which the chain can carry is not reduced as it is where the transfer to the peg is via a bolt or pin.

The fastening peg can also be provided with a slot adapted to take a steel cable, flat plates with pivoting links or a webbing belt with a friction grip.

Figure 2:
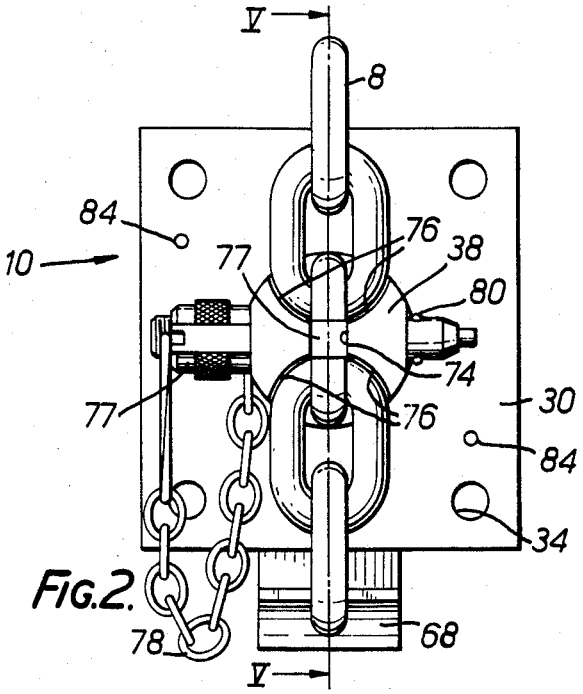
FIG. 2 is a side view of a coupling device which may be used in the system of FIG. 1 connecting a loudspeaker cabinet to a suspension chain.

The cable or chain can be retained in the slot 74 by means of a transverse retaining pin 77, which is shown in FIG. 2 as attached to the body of the peg by means of a safety chain 78 to prevent its loss. The retaining pin 77 is received in a bore 79 (FIG. 5) which traverses the slot. The pin 77 is prevented from inadvertent removal by two detents 80 which engage with the outer surfaces of the peg 38. Such a retaining pin marketed under the trade mark "PIP" pin has detents and is suitable where the loading on the coupling is not excessive. However where the loading may be high it is preferred to use a conventional bolt which is retained in position by means of a nut, preferably a self-locking nut (see FIG. 8).

It will be appreciated that in the described coupling device 10 the peg 38 is able to rotate about its own axis. It can also be seen that the chain 8 can pivot about a horizontal axis parallel to the axis of the retaining pin 77. Therefore the chain can freely move within a hemisphere based on the plane of the housing in the FIG. 2 embodiment. This type of coupling device allows the cabinets 12 to hang at various positions relative to the horizontal. The motion limiting washer 100 limits these angular relationships to slightly less than those defined by hemisphere but the advantage is gained of enabling the chain to be safely fully loaded.

The operation of the coupling device described above is particularly simple in that in order to lock the fastening peg 38 into the housing 30 it is only necessary to push the end portion of the peg into the housing 30 so that the collar 72 engages on the outer surface of the housing. The slide member 42 automatically moves into its locking position on actuation of the actuating member 50 (if fitted) and positively locked by the locking member 60. If no actuating member is fitted then the action of the spring 49 is sufficient to ensure locking action, assisted by spring 61. Therefore there is no need for the operator to use more than one hand to control the motion of the fastening peg.

The device is equally easy to release with the use of one hand. The operator simply applies pressure on the release portion 68 to push it inwardly and upwardly and thus displace the slide member back into its second position where it is automatically retained so that the pin can then be removed with the same hand.

For rapid reassembly the fastening pegs 38 may be left connected to the chain 8 at the required spacings when the device is used in a flying system built up from cabinets of the same size and sequence.

Figure 10:
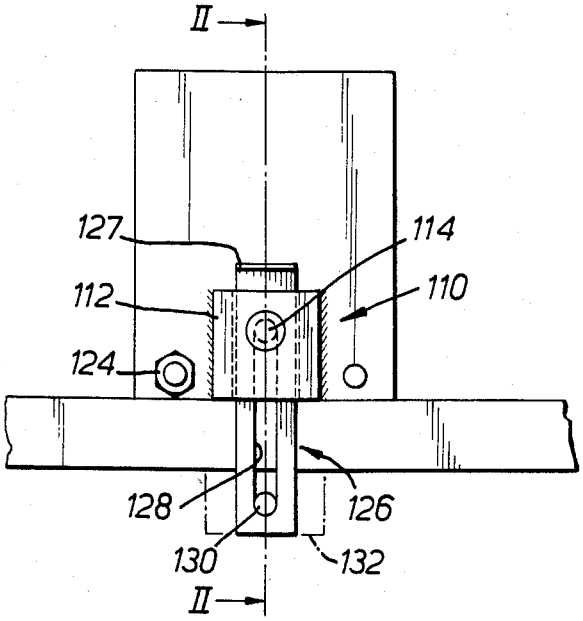
FIG. 10 is a side elevation showing a coupling assembly enabling close coupling of two cabinets.
Figure 11:
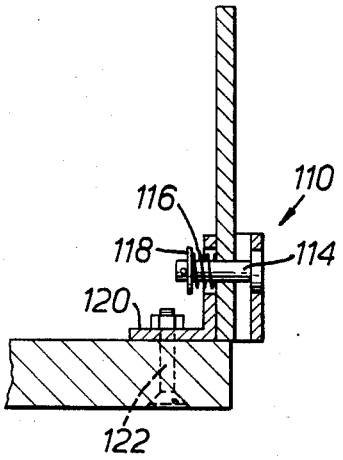
FIG. 11 is a section on the line II—II of FIG. 10, but with some parts omitted.
Figure 12:
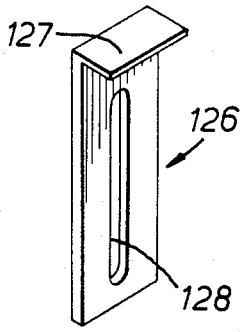
FIG. 12 is a perspective view of a slide member of the coupling assembly.

A fastener as illustrated in FIGS. 10,11 and 12 can be used in conjunction with the apparatus of FIGS. 1 to 9. This fastener 110 includes parts which are permanently mounted adjacent the edges of two adjacent cabinets and parts which are employed only when the two cabinets are to be coupled.

The fixed parts include a channel section member 112 which is welded along its edges to the material of the cabinet and this member has an aperture which receives the head of a pin 114. The pin also passes through an aperture in the adjacent wall of the cabinet and is subjected to the bias of a spring 116 acting between a washer 118 and the material defining the aperture in the cabinet. Internally, the cabinet is reinforced by an angle member 120 which is secured by nuts and bolts 122 (only one shown) in one wall (the lower as shown in FIG. 11) and by further nuts and bolts 124 in the adjacent wall.

The parts only used when two cabinets are to be close coupled are a slide member 126 with a central slot 128 and a "PIP" pin 130 of conventional form which is engaged in one end of the slot 128 and in apertures in a wall of the adjacent cabinet and in a reinforcing plate 132 (broken lines) on the inside of the wall. The slide member 126 is again guided over the reinforcing plate 132 by an inverted channel section member having an aligned aperture for receiving the "PIP" pin 130 but this plate has been omitted for the sake of clarity. The edge of the second cabinet will also be reinforced by an angle member and associated parts.

In use, the slide member 126 is moved from a retracted position by a tab 127 from a position where one end is contiguous with the adjacent edge of the cabinet to a position where that end overlies the apertures which receive the pit pin. Coupling is thus very simple, requiring no tools and the operation is also very rapid.

The pin 114 serves to guide the slide member in the longitudinal direction of its lot and at the same time provides a friction action to prevent the slide member moving except when a manual force is applied.

We claim:

1. Apparatus for flying a sound system including a plurality of loudspeaker cabinets, said apparatus comprising coupling means for connecting said loudspeaker cabinets one above the other in the form of a stack, a suspension frame or other support structure beneath which the stack of loudspeaker cabinets is suspended, means for adjusting the orientation of the cabinets relative to one another within the stack, and means for securing the stack of suspended cabinets in the adjusted positions, said adjustment securing means also depending from the suspension frame or other support structure.

2. Apparatus according to claim 1, wherein the adjusting means are adapted to enable variation in the relative positions of the loudspeaker cabinets after the suspension has been completed.

3. Apparatus according to claim 1, wherein said coupling means comprises a pair of chains depending from the suspension frame or other support structure, and coupling devices one mounted to each of two opposed sides of each loudspeaker cabinet, the coupling devices permitting pivotal motion of the chains with respect to the cabinets.

4. Apparatus according to claim 1, wherein the adjusting means comprises a webbing strap depending from the suspension frame or other support structure, and means for releasably connecting said stack to the webbing strap.

5. Apparatus according to claim 4, wherein the adjusting means further comprises means to adjust a length of said strap between the suspension frame or other support structure and the stack, whereby to vary the relative positions of the loudspeaker cabinets.

6. Apparatus according to claim 3, wherein each coupling device comprises a housing and a fastening peg receivable in an opening of the housing, the housing including means operable upon insertion of the peg in the opening to automatically lock the peg therein.

7. Apparatus according to claim 3, wherein each said coupling device includes a housing mounted to one said side of said loudspeaker cabinet, said housing defining a channel, a slide member received in said channel so as to be longitudinally movable between a first, locked, position and a second, open, position, holding means for holding said slide member in said second, open, position, biasing means biasing the slide member towards said first position, a fastening peg, said housing and slide member each having defined therein openings for receiving and fastening peg, which openings overlie in the second position of said slide member, one end of said fastening peg having an annular recess in which the material of the edge defining said opening in the slide member engages when the slide member is in the first position, the other end of said peg having an axially-extending slot formed therein adapted to receive the chain, and means for retaining said chain within said slot.

8. Apparatus according to claim 14, further including actuating means operable when said one end of said fastening peg is fully received in said openings in order to release said holding means and allow the slide member to slide into the first position thereby retaining the fastening peg in said housing.

9. Apparatus according to claim 4, wherein the adjusting means further comprises a further webbing strap, and means for releasably connecting said further strap to each loudspeaker cabinet or to each group of loudspeaker cabinets which are rigidly coupled to one another.

* * * * *